US008544836B2

(12) United States Patent
Terao

(10) Patent No.: US 8,544,836 B2
(45) Date of Patent: Oct. 1, 2013

(54) SHEET PROCESSING APPARATUS AND SHEET PROCESSING METHOD

(75) Inventor: Yasunobu Terao, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/532,285

(22) Filed: Jun. 25, 2012

(65) Prior Publication Data

US 2012/0325062 A1 Dec. 27, 2012

Related U.S. Application Data

(60) Provisional application No. 61/501,715, filed on Jun. 27, 2011.

(51) Int. Cl.
*B26D 5/08* (2006.01)

(52) U.S. Cl.
USPC ..... 270/58.07; 270/58.04; 270/58.09

(58) Field of Classification Search
USPC ..... 270/58.04, 58.07, 58.09; 83/72, 83/76.7, 76.8, 360, 368, 370
See application file for complete search history.

(56) References Cited

U.S. PATENT DOCUMENTS

| | | | |
|---|---|---|---|
| 5,839,336 | A * | 11/1998 | Yamauchi et al. |
| 7,520,498 | B2 * | 4/2009 | Hattori et al. |
| 7,950,647 | B2 * | 5/2011 | Iguchi et al. |
| 8,028,980 | B2 * | 10/2011 | Fukasawa et al. |
| 2007/0227324 | A1 | 10/2007 | Baba |

FOREIGN PATENT DOCUMENTS

| | | |
|---|---|---|
| JP | 2009-208872 | 9/2009 |

* cited by examiner

*Primary Examiner* — Leslie A Nicholson, III
(74) *Attorney, Agent, or Firm* — Patterson & Sheridan, L.L.P.

(57) ABSTRACT

A sheet processing apparatus includes a punch motor, an actuator which rotates by driving of the punch motor, a punching blade which punches a sheet by driving of the actuator, and a controller which controls the driving of the punch motor so that approach run is gained, if a thickness of the sheet exceeds a threshold, in a rotating direction of the actuator in which the punching blade does not move at the beginning of the driving of the punch motor.

18 Claims, 11 Drawing Sheets

SHEET PROCESSING APPARATUS AND SHEET PROCESSING METHOD

CROSS-REFERENCE TO RELATED APPLICATIONS

This application is based upon and claims the benefit of priority from U.S. provisional application 61/501,715, filed on Jun. 27, 2011, the entire contents of each of which are incorporated herein by reference.

FIELD

Embodiments described herein relate generally to a sheet processing apparatus and a sheet processing method for punching a sheet.

BACKGROUND

In recent years, in an image forming apparatus (e.g., MFP: multi-function peripheral), a sheet finishing apparatus is arranged adjacent to a post stage of the MFP in order to apply finishing to a sheet subjected to image formation. The sheet finishing apparatus is also called finisher. The sheet finishing apparatus applies punching and stapling to a sheet sent from the MFP. The finisher includes, in order to punch the sheet, a punching unit including plural punching blades. The punching blades ascend and descend according to the rotation of a punch motor.

A sheet sent from the image forming apparatus is sometimes skewed. If the sheet is punched while remaining skewed, a problem occurs in filing the sheet. Therefore, a skew correcting device is provided to correct the skew of the sheet before the sheet is punched.

After punching the sheet, the punching blades ascend to a standby position (a home position) spaced away from the sheet surface. The punching blades are moved in a direction orthogonal to a conveying direction of the sheet, whereby a sensor, which detects the lateral ends of the conveyed sheet, detects the size of the conveyed sheet.

In the related art, there is a drawback in that, if the sheet to be punched is relatively thick, the punch motor needs a large electric current or it is necessary to provide the punch motor having a large driving force.

DETAILED DESCRIPTION

A sheet processing apparatus and a sheet processing method according to a present embodiment are explained with reference to the accompanying drawings.

In general, according to one embodiment, a sheet processing apparatus includes: a punch motor; an actuator configured to rotate by driving of the punch motor; a punching blade configured to punch a sheet by driving of the actuator; and a controller configured to control the driving of the punch motor so that approach run is gained, if a thickness of the sheet exceeds a threshold, in a rotating direction of the actuator in which the punching blade does not move at the beginning of the driving of the punch motor.

In general, according to one embodiment, a sheet processing apparatus which has a punch motor, an actuator configured to rotate by driving of the punch motor, and a punching blade configured to punch a sheet by driving of the actuator, includes control means for controlling the driving of the punch motor so that approach run is gained, if a thickness of the sheet exceeds a threshold, in a rotating direction of the actuator in which the punching blade does not move at the beginning of the driving of the punch motor.

In general, according to another embodiment, a sheet processing method includes: acquiring a rotation angle of an actuator which rotates by driving of a punch motor; and controlling the driving of the punch motor so that approach run is gained, if a thickness of the sheet exceeds a threshold, in a rotating direction of the actuator in which the punching blade does not move at the beginning of the driving of the punch motor.

Figure 1:
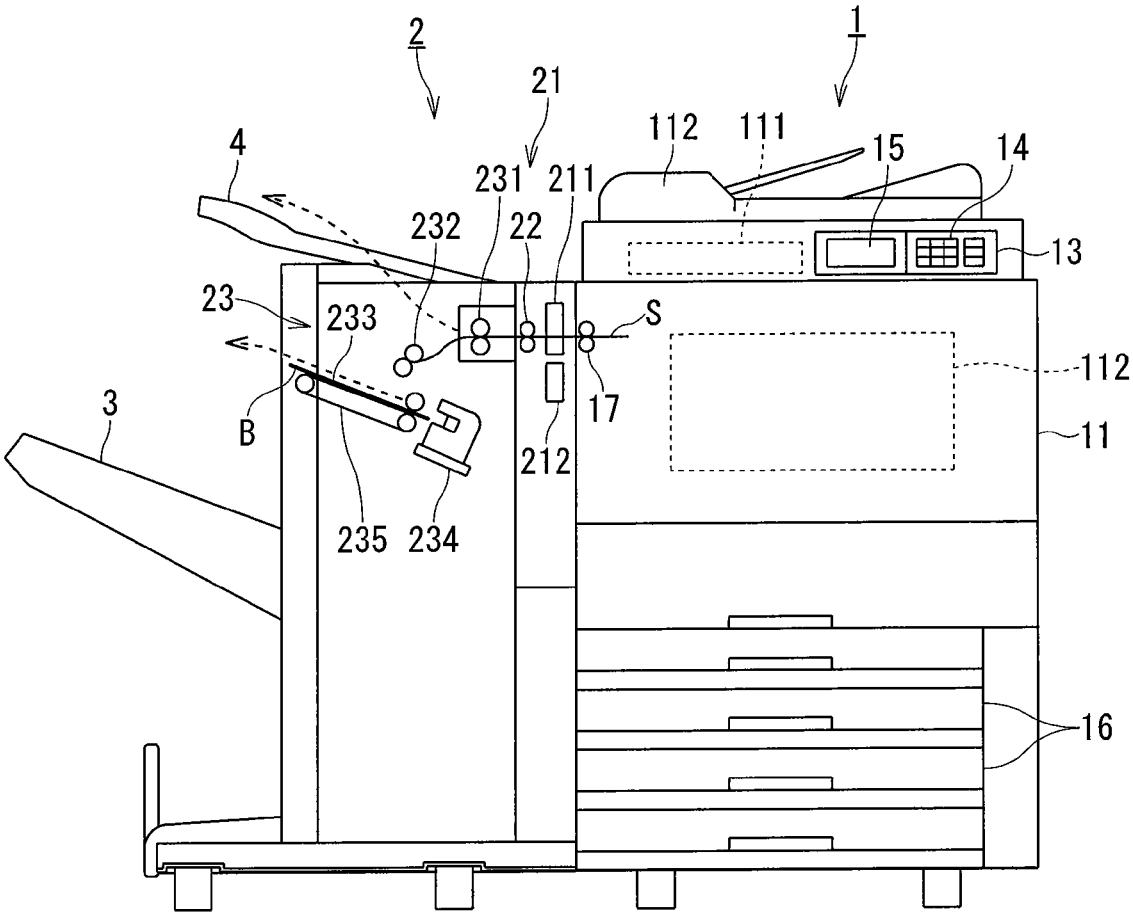
FIG. 1 is a configuration diagram of a sheet processing apparatus according to a present embodiment.

FIG. 1 is a configuration diagram of the sheet processing apparatus according to the present embodiment.

FIG. 1 shows an image forming apparatus 1, a sheet processing apparatus (a finisher) 2 according to this embodiment, a paper discharge tray 3, and a fixed tray 4. The image forming apparatus 1 is, for example, an MFP (multi-function peripheral), which is a compound machine, a printer, or a copying machine. The sheet processing apparatus 2 is arranged adjacent to the image forming apparatus 1. The image forming apparatus 1 feeds a sheet S having an image formed thereon to the sheet processing apparatus 2.

The image forming apparatus 1 includes a main body 11. A document table is provided in an upper part of the main body 11. An auto document feeder (ADF) 12 is openably and closably provided on the document table. An operation panel 13 is provided in an upper part of the main body 11. The operation panel 13 includes an operation section 14 including various keys and a display section 15 of a touch panel type.

The main body 11 includes a scanner unit 111 and a printer unit 112 on the inside thereof. The scanner unit 111 reads an original document fed by the ADF 12 or an original document placed on the document table. The printer unit 112 includes a photoconductive drum and a laser. The printer unit 112 scans and exposes the surface of the photoconductive drum with a laser beam from the laser and generates an electrostatic latent image on the photoconductive drum. A charger, a developing device, a transfer device, and the like are arranged around the photoconductive drum. The electrostatic latent image on the photoconductive drum is developed by the developing device. A toner image is formed on the photoconductive drum. The toner image is transferred onto a sheet by the transfer device. The configuration of the printer unit 112 is not limited to the example explained above and may be various types.

In the image forming apparatus 1, plural cassettes 16, in which sheets of various sizes are stored, are provided in a lower part of the main body 11.

In the image forming apparatus 1, a conveying roller 17 that conveys the sheet S, which is fed from the main body 11, to the sheet processing apparatus 2 is supported on a side of the main body 11.

The sheet processing apparatus 2 applies finishing such as punching, sorting, and stapling to the sheet S fed from the image forming apparatus 1. The sheet processing apparatus 2 includes a punching unit 21 that punches the sheet S, a conveying roller 22 that conveys the punched sheet S, and a staple unit 23 that applies stapling to the sheet S conveyed from the punching unit 21. The sheet processing apparatus 2 discharges the sheet S subjected to the finishing to the paper discharge tray 3 or the fixed tray 4.

The punching unit 21 is arranged between the main body 11 of the image forming apparatus 1 and the staple unit 23. The punching unit 21 includes a punching body 211 and a dust box 212.

The configuration and the operation of the punching body 211 are explained below.

The dust box 212 receives and stores punching dust caused and dropped by the operation for punching by the punching body 211. The punching by the punching unit 21 is performed when a user operates the operation panel 13 and a punching mode is set.

The conveying roller 22 conveys the sheet S punched by the punching unit 21 to the staple unit 23.

The staple unit 23 includes an inlet roller 231 that receives the sheet S from the conveying roller 22, a paper feeding roller 232 that receives the sheet S from the inlet roller 231 on a downstream side of the inlet roller 231, a processing tray 233 on which the sheet S received by the paper feeding roller 232 is stacked, a stapler 234 that staples plural sheets S stacked on the processing tray 233, and a conveyor belt 235 that conveys a stapled sheet bundle B.

The staple unit 23 includes an aligning device (not shown in the figure) that aligns the sheet S, which is conveyed from the conveying roller 22, in the width direction. The staple unit 23 can sort and discharge the sheet S using the aligning device. In some cases, the staple unit 23 includes a waiting tray (not shown in the figure) on which the sheet S conveyed from the conveying roller 22 is stacked and from which a required number of sheets S are dropped to the processing tray 233. If the finishing such as punching and stapling is not performed, the staple unit 23 directly discharges the sheet S, which is fed from the main body 11 of the image forming apparatus 1, to the paper discharge tray 3 or the fixed tray 4.

The operation of the staple unit 23 is briefly explained.

The sheet S fed from the punching unit 21 is received by the inlet roller 231 of the staple unit 23 via the conveying roller 22. The sheet S received by the inlet roller 231 is stacked on the processing tray 233 via the paper feeding roller 232.

The plural sheets S stacked on the processing tray 233 are led to the stapler 234 and stapled by the stapler 234. The stapled sheet bundle B (or the sorted plural sheets S) is conveyed to the paper discharge tray 3 via the conveyor belt 235. The sheet bundle B conveyed by the conveyor belt 235 is discharged to the paper discharge tray 3. The paper discharge tray 3 ascends and descends to receive the sheet bundle B.

In some cases, the sheet processing apparatus 2 discharges the sheet S to the paper discharge tray 3 without stapling the sheet S. If the sheet processing apparatus 2 does not staple the sheet S, the sheet processing apparatus 2 discharges the sheet S to the fixed tray 4 without dropping the sheet S to the processing tray 233.

The configuration and the operation of the punching body 211 are explained.

FIGS. 2A to 2D are respectively perspective views of examples of the punching body 211.

As shown in FIGS. 2A to 2D, the punching body 211 includes a punch motor 303A functioning as a DC motor, an actuator 303C that generates triggers for driving and stopping the punch motor 303A, a slide link 303D reciprocatingly moved by the punch motor 303A, and punching heads 301 including punching blades at the lower ends. The punching body 211 shown in FIG. 2A includes two punching heads 301. The punching body 211 shown in FIG. 2B includes four punching heads 301. The punching body 211 shown in FIG. 2C includes five punching heads 301. The punching body 211 shown in FIG. 2D includes four punching heads 301.

Figure 2A:
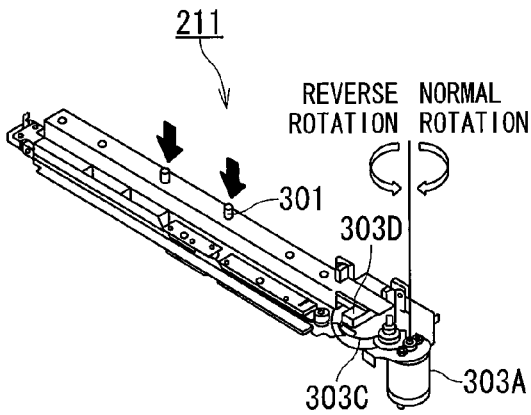
FIGS. 2A to 2D are respectively perspective views of examples of a punching body.
Figure 2C:
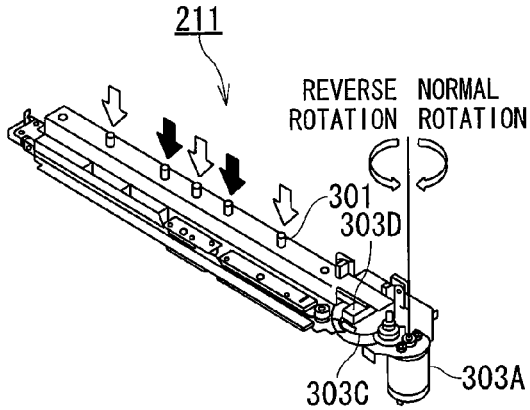
Figure 2B:
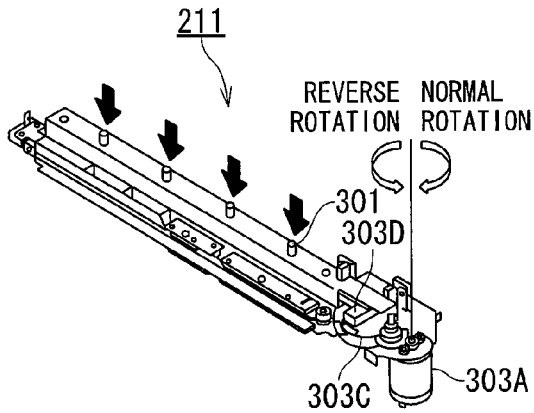
Figure 2D:
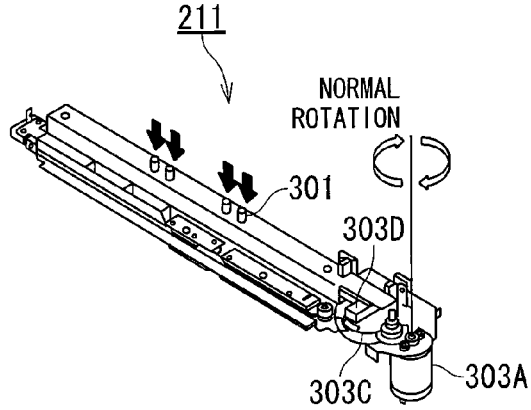

In the following explanation, unless specifically referred to, the punching body 211 of the punching types shown in FIG. 2B is explained as an example.

Figure 3:
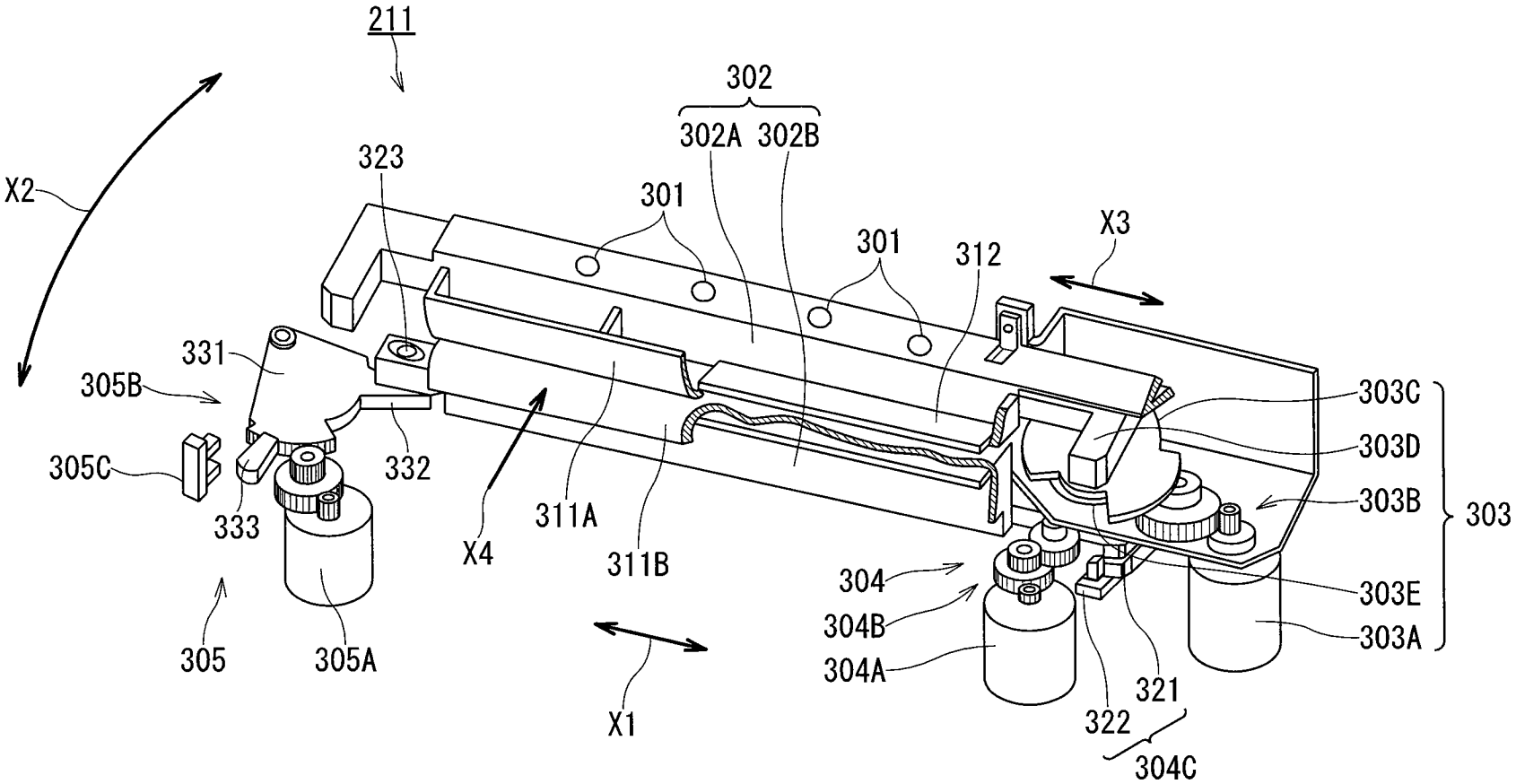
FIG. 3 is a perspective view of the punching body.
Figure 4:
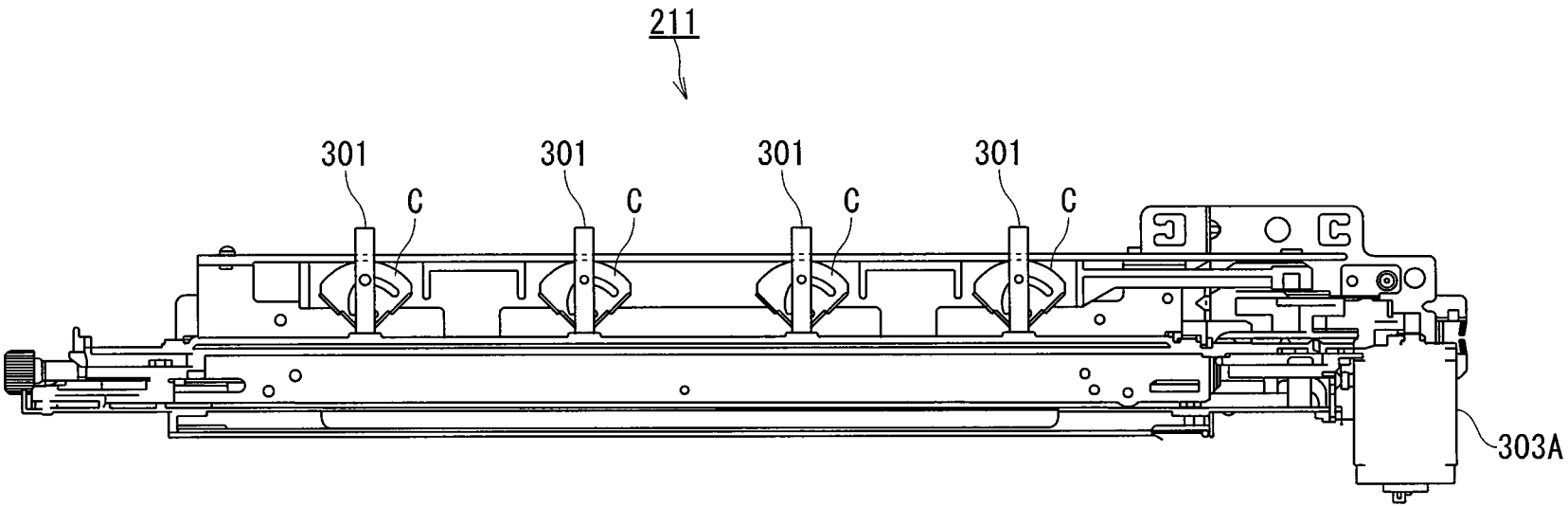
FIG. 4 is a side view of the internal structure of the punching body.

FIG. 3 is a perspective view of the punching body 211. FIG. 4 is a side view of the internal structure of the punching body 211.

The punching body 211 includes a function of punching the sheet S carried in from the main body 11 (shown in FIG. 1) and a function of correcting a skew of the sheet S. The punching body 211 includes a plural punch heads 301 that punch the sheet S, a punch portion 302 that has the punch heads 301, a driver 303 that drives the punch heads 301, a lateral register 304 that aligns a punching position against misalignment in a width direction (hereinafter "a lateral direction") of the sheet S, a rotational register 305 that aligns a punching position against the skew of the sheet S.

The punch portion 302 includes a supporter 302A that supports the punch heads 301, and a receiver 302B having support holes that receive lower ends of punching blades E (shown in FIGS. 7 and 9) of the respectively punch heads 301 when punching. The supporter 302A and the receiver 302B of the punch portion 302 attach guides 311A and 311B that guide the sheet S to be conveyed, respectively.

The punch portion 302 includes a light emission unit and a light receiving unit (not shown in the figure). Further, the punch portion 302 includes a lateral edge censer 312 that detects the sheet S passing through between the light emission unit and the light receiving unit.

The driver 303 includes the punch motor 303A, a gear 303B that transmits driving of the punch motor 303A to the punch heads 301, the actuator 303C that rotates by driving of the punch motor 303A, the slide link 303D that slides via the gear 303B, and a rotation-angle censer 303E that detects data of a rotation-angle in a stop position of the actuator 303C. The slide link 303D includes cams C in the supporter 302A.

In the present embodiment, the slide link 303D slides in directions shown as arrowed lines X3 when the driving of the punch motor 303A is transmitted to the slide link 303D via the gear 303B. The cams C transforms driving of slide movements of the slide link 303D into vertical movements of the punch heads 301. The driver 303 lowers the punch heads 301 and punches the sheet S.

The driver 303 is movable with the punch portion 302 as a unit.

The lateral register 304 aligns the punching position against misalignment in the lateral direction of the sheet S, which is in a direction perpendicular to a sheet conveying direction on the punch portion 302. The lateral register 304 includes a lateral register motor 304A as a stepping motor, a pinion gear 304B, and a lateral spanning unit 304C having a rack (not shown in the figure), which is attached to an end of the punch portion 302. Driving of the lateral register motor 304A is propagated to the lateral spanning unit 304C via the pinion gear 304B occluded to the rack. Further, the lateral spanning unit 304C of the lateral register 304 includes a lateral register actuator 321, a lateral register censer 322, which detects a home position in a lateral direction of the punch portion 302, a rotational register through-hole 323 as a through-hole, which is long in a longer direction of the receiver 302B.

The slide link 303D is dislocated in conjunction with the receiver 302B in directions shown as arrowed lines X1 within the range of a length of a lateral register through-hole (not shown in the figure) when the lateral register motor 304A is driven.

The rotational register 305 includes a rotational register driver 305A as a stepping motor, a rotational register gear 305B as a gear which propagates driving of the rotational register driver 305A, and a rotational register censer 305C, which detects a home position in a rotational direction of the receiver 302B. The rotational register gear 305B includes an end reduction gear 331, a rotational bar 332 attached to the end reduction gear 331, and a rotational register actuator 333, which marks a position of the receiver 302B in rotational directions shown as arrowed lines X2. The rotational bar 332 has a pin (not shown in the figure). The pin is passed through to the rotational register through-hole 323.

The slide link 303D is dislocated in conjunction with the receiver 302B in rotational directions along a sheet conveying direction shown as arrowed lines X2 within the range of a length of the rotational register through-hole 323 when the rotational register driver 305A is driven.

Although not shown in the figure, the punching body 211 includes a skew censer, a sensor unit, a conveying motor, and a conveying roller. The skew censer includes plural sensors for skew detection. The sensor unit includes plural sensors that detect ends in the lateral direction of the sheet S and a sensor that detects ends in the longitudinal direction of the sheet S. The sensor unit detects the lateral ends, the front end, and the rear end of the sheet S. As the conveying motor, for example, a stepping motor is used. The conveying motor rotates at a fixed number of revolutions. The conveying roller is driven by the conveying motor. The conveying roller conveys the sheet S, which is conveyed from an upstream side of a conveying path (an inlet side to the punching body 211), to a downstream side (an outlet side of the punching body 211) at predetermined moving speed.

A structure for driving the punching blades E using the slide link 303D is a generally-known technique. The gear 303B that transmits the rotation of the punch motor 303A to the slide link 303D, and a member that drives the punching blades E according to the slide of the slide link 3030 configure a driving mechanism. The driving mechanism drives the punching blades E between a punching position where the punching blades E punch a sheet and a standby position spaced apart from the sheet.

Figure 5:
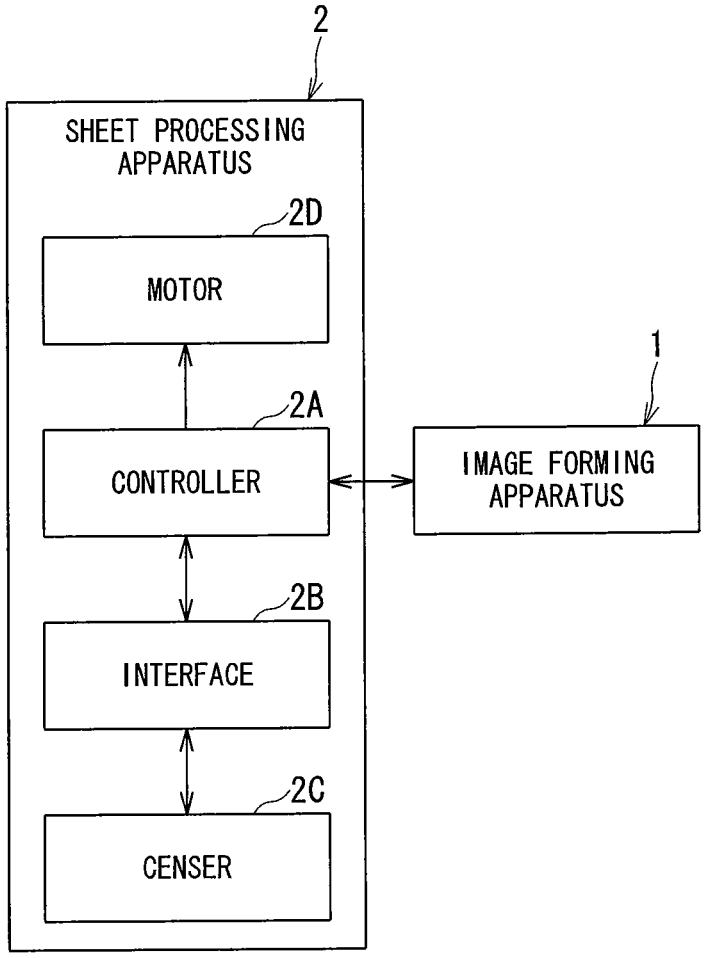
FIG. 5 is a block diagram of a control system of the sheet processing apparatus according to the present embodiment.

FIG. 5 is a block diagram of a control system of the sheet processing apparatus 2 according to this embodiment.

As shown in FIG. 5, the sheet processing apparatus 2 mainly includes a controller 2A, an interface 2B, a censer 2C, and a motor 2D. Signals from each switch of the operation panel 13 of the image forming apparatus 1 or the censer 2C such as the rotation-angle censer 303E (shown in FIG. 3) are input to the controller 2A via the interface 2B. The controller 2A controls, based on the input signals, driving of the motor 2D such as the punch motor 303A (shown in FIG. 3).

Figure 6:
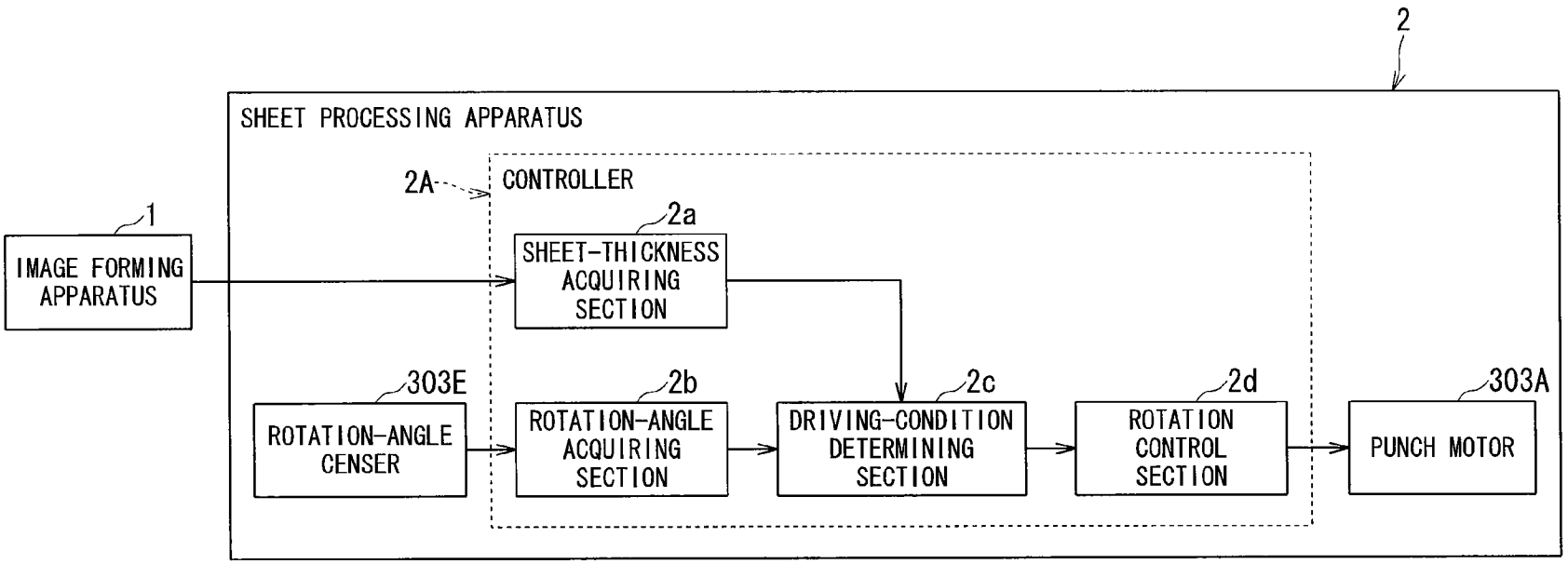
FIG. 6 is a block diagram of functions of the sheet processing apparatus according to the present embodiment.

FIG. 6 is a block diagram of functions of the sheet processing apparatus 2 according to the present embodiment.

The controller 2A including a processor of the sheet processing apparatus 2 executes a computer program, whereby the sheet processing apparatus 2 functions as, as shown in FIG. 6, a sheet-thickness acquiring section 2*a*, a rotation-angle acquiring section 2*b*, a driving-condition determining section 2*c*, and a rotation control section 2*d*. All or a part of the sections 2*a* to 2*d* may be provided as hardware in the sheet processing apparatus 2.

The controller 2A (sheet-thickness acquiring section 2*a*) acquires data concerning the thickness of the sheet S fed from the image forming apparatus 1. For example, the sheet-thickness acquiring section 2*a* acquires the thickness of the sheet S input by an operator from the operation panel 13 (shown in FIG. 1) of the image forming apparatus 1.

The sheet-thickness acquiring section 2*a* may acquire the thickness of the sheet S from a sensor (not shown in the figure) arranged in a sheet conveying path of the image forming apparatus 1 and the sheet processing apparatus 2. If an ultrasonic sensor is used as the sensor, ultrasound is irradiated on the sheet S, which passes through the path, from an oscillation element, detects the ultrasound transmitted through the sheet S in an oscillation receiving element, and detects the thickness of the sheet S from an attenuation amount of both the elements. The sensor may irradiate light on the sheet S, which passes through the path, detect the transmitted light in a light receiving element, and detect the thickness of the sheet S from an attenuation amount of the light. Such a sensor is already widely used.

Besides, for example, in an apparatus configuration in which a sheet feeding path for feeding a sheet is divided into a path for thick paper (a thick paper cassette) and a path for thin paper (a thin paper cassette) in the image forming apparatus 1 and the sheet processing apparatus 2, the sheet-thickness acquiring section 2*a* can be configured to identify whether the sheet is a "thick paper sheet" or a "thin paper sheet" according to supply destination information of the sheet.

The controller 2A (rotation-angle acquiring section 2*b*) acquires data concerning the rotation angle in the stop position of the actuator 303C detected by the rotation-angle censer 303E.

The controller 2A (driving-condition determining section 2*c*) selects, on the basis of the thickness acquired by the sheet-thickness acquiring section 2*a*, "360-degree punching" or "180-degree punching" as a rotation amount of the actuator 303C. If the driving-condition determining section 2*c* determines that the thickness of the sheet S exceeds a threshold (the sheet S is relatively thick), the driving-condition determining section 2*c* selects the 360-degree punching. On the other hand, if the driving-condition determining section 2*c* determines that the thickness of the sheet S is equal to or smaller than the threshold (the sheet S is relatively thin), the driving-condition determining section 2*c* selects the 180-degree punching.

The controller 2A (driving-condition determining section 2*c*) determines a rotating direction of the actuator 303C on the basis of the rotation angle of the actuator 303C acquired by the rotation-angle acquiring section 2*b* and the selected rotation amount of the actuator 303C. When the driving-condition determining section 2*c* selects the 360-degree punching, the driving-condition determining section 2*c* determines, on the basis of the rotation angle of the actuator 303C, a direction in which the punching blades E idly rotate as the rotating direction of the actuator 303C. On the other hand, when the driving-condition determining section 2*c* selects the 180-degree punching, the driving-condition determining section 2*c* determines, on the basis of the rotation angle of the actuator 303C, a direction in which the punching blades E do not idly rotate as the rotating direction of the actuator 303C. The operation of the cams C moving by the actuator 303C and the slide link 303D is explained below.

The controller 2A (rotation control section 2*d*) controls the driving of the punch motor 303A on the basis of the rotating direction and the rotation amount of the actuator 303C determined by the driving-condition determining section 2*c*.

First, the "180-degree punching" in the sheet processing apparatus 2 according to the present embodiment is explained.

Figure 7:
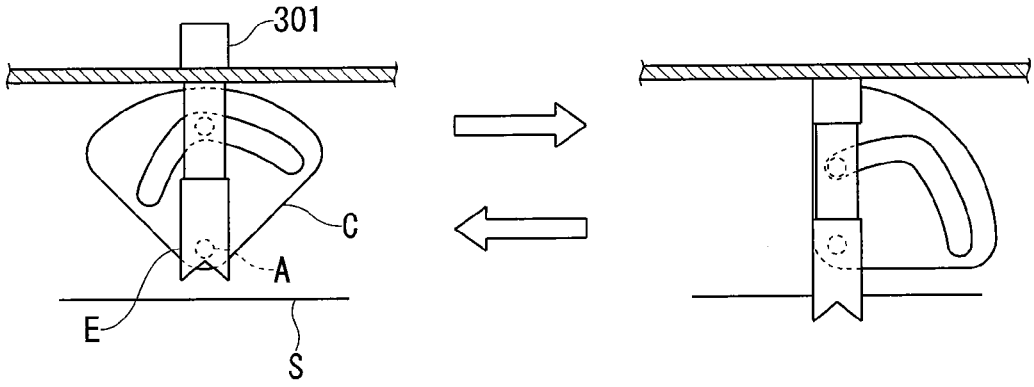
FIG. 7 is an outline diagram to explain an operation of cams and punching blades when a controller drives a punching unit under "180-degree punching"

FIG. 7 is an outline diagram to explain an operation of the cams C and the punching blades E when the controller 2A drives the punching unit 21 under the "180-degree punching".

Each of the cams C swings as a fulcrum in a shaft A.

Specifically, all the four cams C are rotated in the direction in which the punching blades E do not idly rotate, whereby the cams C transition from a state shown on the left in FIG. 7 to a state shown on the right in FIG. 7. In this case, the punching blades E are lowered toward the sheet S and the sheet S is punched. All the four cams C are continuously rotated, whereby the cams C transition from the state shown on the right in FIG. 7 to the state shown on the left in FIG. 7. In this case, the punching blades E are lifted to a home position spaced apart from the sheet surface.

Figure 8:
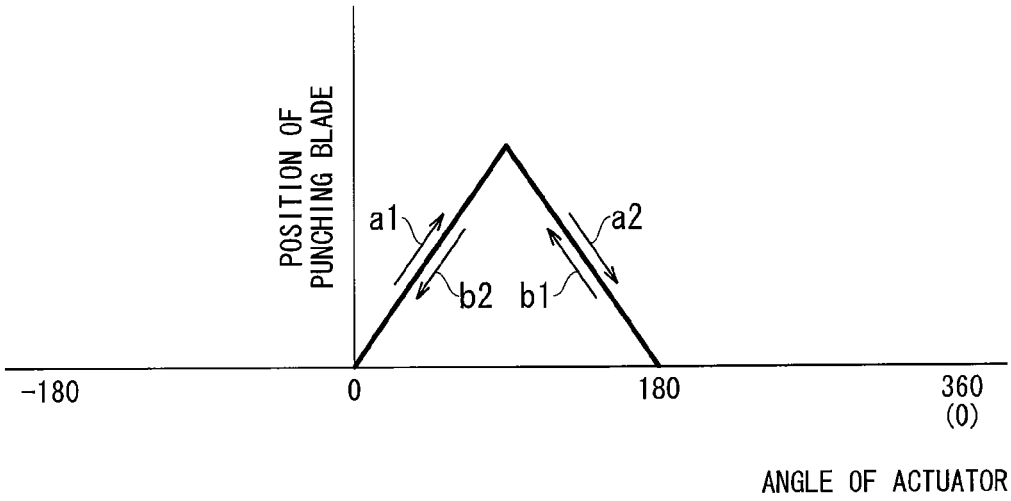
FIG. 8 is a diagram of displacement of a rotation angle of an actuator when the controller drives the punching unit under the "180-degree punching"

FIG. 8 is a diagram of displacement of a rotation angle of the actuator 303C when the controller 2A drives the punching unit 21 under the "180-degree punching".

The sheet S is set in the punching unit 21 when the stop position of the actuator 303C is at a rotation angle of 0 degree. The punch motor 303A is controlled such that the actuator 303C is rotated to 180 degrees (the 180-degree punching) in the direction in which the punching blades E do not idly rotate (the direction in which the punching blades E moves from the beginning of the driving of the punch motor 303A). That is, the position of the punching blades E advances according to an arrowed line a1, and then the position advances according to an arrowed line a2 via a peak (a position when the punching blades punch out).

The sheet S is set in the punching unit 21 when the stop position of the actuator 303C is at a rotation angle of 180 degrees. The punch motor 303A is controlled such that the actuator 303C is rotated to 0 degree (the 180-degree punching) in the direction in which the punching blades E do not idly rotate (the direction in which the punching blades E moves from the beginning of the driving of the punch motor 303A). That is, the position of the punching blades E advances according to an arrowed line b1, and then the position advances according to an arrowed line b2 via a peak (a position when the punching blades E punch out).

In the related art, as explained with reference to FIGS. 7 and 8, the reverse rotation and the normal rotation of the punch motor 303A are only alternately repeated such that punching is performed in the direction in which the punching blades E do not idly rotate. In the related art, the punch motor 303A is controlled to perform 180-degree punching in a rotating direction of the actuator 303C in which the punching blades E does not idly rotate.

Figure 9:
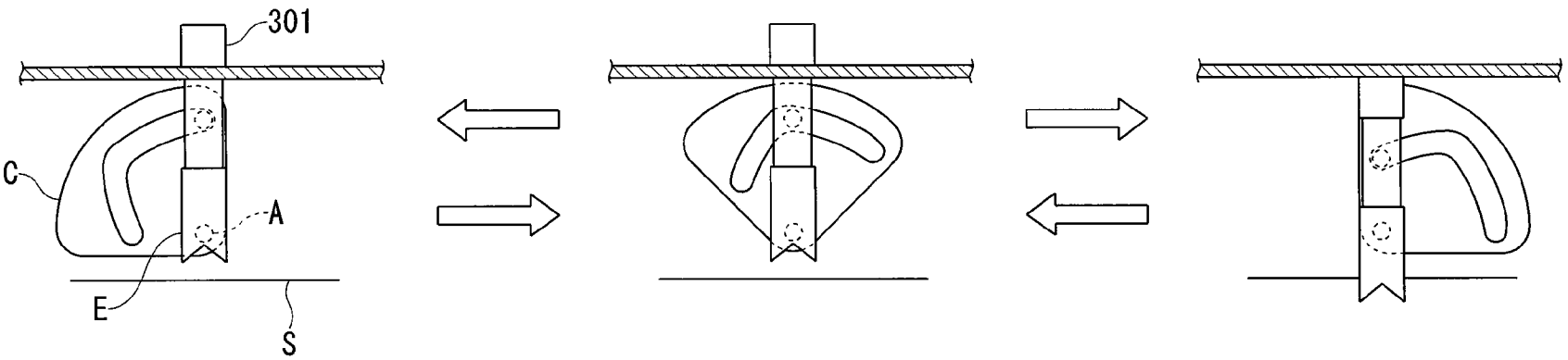
FIG. 9 is an outline diagram to explain an operation of the cams and the punching blades when the controller drives the punching unit under "360-degree punching"

FIG. 9 is an outline diagram to explain the operation of the cams C and the punching blades E when the controller 2A drives the punching unit 21 under the "360-degree punching". A state shown in the center in FIG. 9 is equal to the state on the left in FIG. 7. A state shown on the right in FIG. 9 is equal to the state on the right in FIG. 7.

The lead pin L shown in FIG. 9 is supported by the punching head 301, and moves along the groove G formed in each of the cams C.

When the controller 2A (driving-condition determining section 2*c*) selects the 360-degree punching, the controller 2A (the rotation control section 2*d*) controls the punch motor 303A to perform the 360-degree punching in the direction in which the punching blades E idly rotate.

Specifically, the controller 2A (rotation control section 2*d*) rotates all the four cams C in the direction in which the punching blades E idly rotate, whereby the cams C transition from the state shown in the center in FIG. 9 to the state shown on the left in FIG. 9. The controller 2A (rotation control section 2*d*) continuously rotates all the four cams C, whereby the cams C transition from the state shown on the left in FIG. 9 to the state shown in the center in FIG. 9. The controller 2A (rotation control section 2*d*) continuously rotates all the four cams C, whereby the cams C transition from the state shown in the center in FIG. 9 to the state shown on the right in FIG. 9. In this case, the punching blades E are lowered toward the sheet S and the sheet S is punched. The controller 2A (rotation control section 2*d*) continuously rotates all the four cams C, whereby the cams C transition from the state shown on the right in FIG. 9 to the state shown in the center in FIG. 9. In this case, the punching blades E are lifted to the home position spaced apart from the sheet surface.

On the other hand, if the controller 2A (driving-condition determining section 2*c*) selects the 180-degree punching, the controller 2A (rotation control section 2*d*) controls the punch motor 303A to perform the 180-degree punching in the direction in which the punching blades E do not idly rotate.

Specifically, the controller 2A (rotation control section 2*d*) rotates all the four cams C in the direction in which the punching blades E do not idly rotate, whereby the cams C transition from the state shown in the center in FIG. 9 to the state shown on the right in FIG. 9. In this case, the punching blades E are lowered toward the sheet S and the sheet S is punched. The controller 2A (rotation control section 2*d*) continuously rotates all the four cams C, whereby the cams C transition from the state shown on the right in FIG. 9 to the state shown in the center in FIG. 9. In this case, the punching blades E are lifted to the home position spaced apart from the sheet surface.

Figure 10:
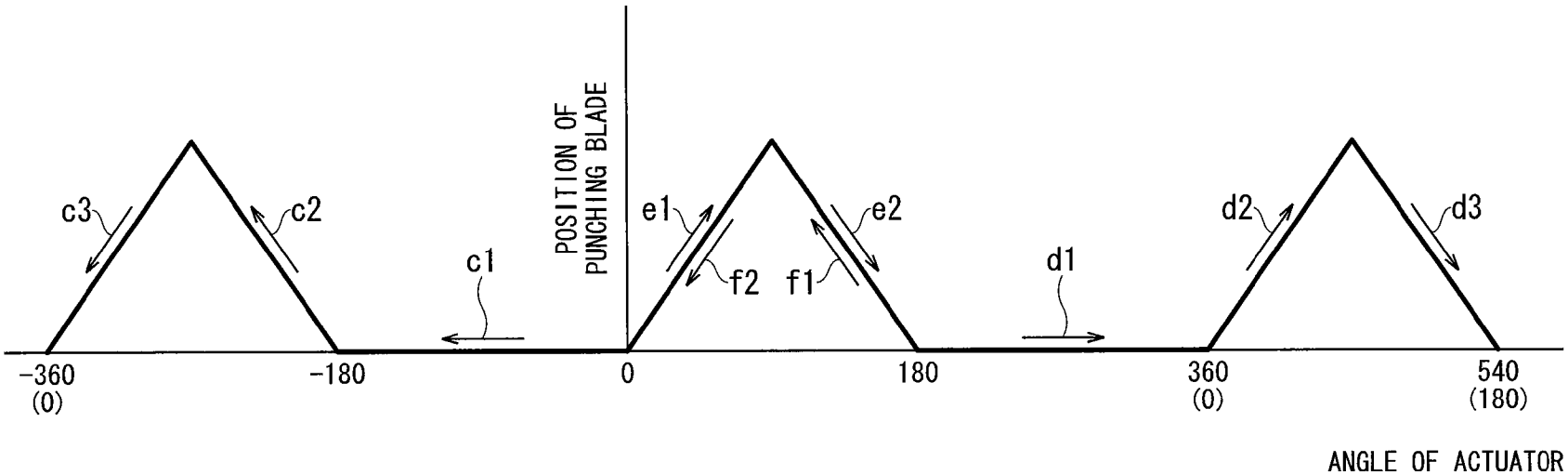
FIG. 10 is a diagram of displacement of a rotation angle of the actuator in the sheet processing apparatus according to the present embodiment.

FIG. 10 is a diagram of displacement of a rotation angle of the actuator 303C in the sheet processing apparatus 2 according to the present embodiment.

It is assumed that the stop position of the actuator 303C is at a rotation angle of 0 degree and the 360-degree punching is selected by the controller 2A (driving-condition determining section 2*c*). In this case, when the sheet S is set in the punching unit 21, the controller 2A (rotation control section 2*d*) controls the punch motor 303A to rotate the actuator 303C to −360 degrees in the direction in which the punching blades E idly rotate (the direction in which the punching blades E do not move at the beginning of the driving of the punch motor 303A). That is, the position of the punching blades E advances from an arrowed line c1 as a direction in which the punching blades E idly rotate (the direction in which the punching blades E do not move at the beginning of the driving of the punch motor 303A), to an arrowed line c2, and then the position advances according to an arrowed line c3 via a peak (a position when the punching blades E punch out). When the stop position of the actuator 303C is at a rotation angle of 0 degree and the 360-degree punching is selected, the controller 2A (rotation control section 2*d*) controls the punch motor 303A so that approach run is gained from 0 degree to −180 degrees before punching.

It is assumed that the stop position of the actuator 303C is at a rotation angle of 180 degrees and the 360-degree punching is selected by the controller 2A (driving-condition determining section 2*c*). In this case, when the sheet S is set in the punching unit 21, the controller 2A (rotation control section 2*d*) controls the punch motor 303A to rotate the actuator 303C to 540 degrees in the direction in which the punching blades E idly rotate (the direction in which the punching blades E do not move at the beginning of the driving of the punch motor 303A). That is, the position of the punching blades E advances from an arrowed line d1 as a direction in which the punching blades E idly rotate (the direction in which the punching blades E do not move at the beginning of the driving of the punch motor 303A), to an arrowed line d2, and then the position advances according to an arrowed line d3 via a peak (a position when the punching blades E punch out). When the stop position of the actuator 303C is at a rotation angle of 180 degree and the 360-degree punching is selected, the controller 2A (rotation control section 2*d*) controls the punch motor 303A so that approach run is gained from 180 degrees to 540 degrees before punching.

In this way, the rotating directions of the actuator 303C are opposite when the rotation angle in the stop position of the actuator 303C is 0 degrees and when the rotation angle is 180 degrees.

On the other hand, it is assumed that the stop position of the actuator 303C is at the rotation angle of 0 degree and the 180-degree punching is selected by the controller 2A (driving-condition determining section 2*c*). In this case, when the sheet S is set in the punching unit 21, the controller 2A (rotation control section 2*d*) controls the punch motor 303A to rotate the actuator 303C to 180 degrees in the direction in which the punching blades E do not idly rotate (the direction in which the punching blades E moves from the beginning of the driving of the punch motor 303A). That is, the position of the punching blades E advances according to an arrowed line e1 as a direction in which the punching blades E do not idly rotate (the direction in which the punching blades E move from the beginning of the driving of the punch motor 303A), and then the position advances according to an arrowed line e2 via a peak (a position when the punching blades E punch out).

It is assumed that the stop position of the actuator 303C is at the rotation angle of 180 degrees and the 180-degree punching is selected by the controller 2A (driving-condition determining section 2*c*). In this case, when the sheet S is set in the punching unit 21, the controller 2A (rotation control section 2*d*) controls the punch motor 303A to rotate the actuator 303C to 0 degree in the direction in which the punching blades E do not idly rotate (the direction in which the punching blades E moves from the beginning of the driving of the punch motor 303A). That is, the position of the punching blades E advances according to an arrowed line f1 as a direction in which the punching blades E do not idly rotate (the direction in which the punching blades E move from the beginning of the driving of the punch motor 303A), and then the position advances according to an arrowed line f2 via a peak (a position when the punching blades E punch out).

As explained with reference to FIGS. 9 and 10, if the 360-degree punching is selected, the sheet processing apparatus 2 according to this embodiment can perform punching with the punching blades E propelled by securing a rotation range of all the four cams C large and using cam curves (displacement in time series of the height of the lead pins L) wide.

If the 360-degree punching is selected by the controller 2A (driving-condition determining section 2*c*), the sheet processing apparatus 2 transmits a punching time to the image processing apparatus 1. It is desirable that the sheet processing apparatus 2 sets pickup speed for the sheet S conveyed from the image processing apparatus 1 low, or sets delay time long, when the 360-degree punching is selected compared with when the 180-degree punching is selected.

Figure 11:
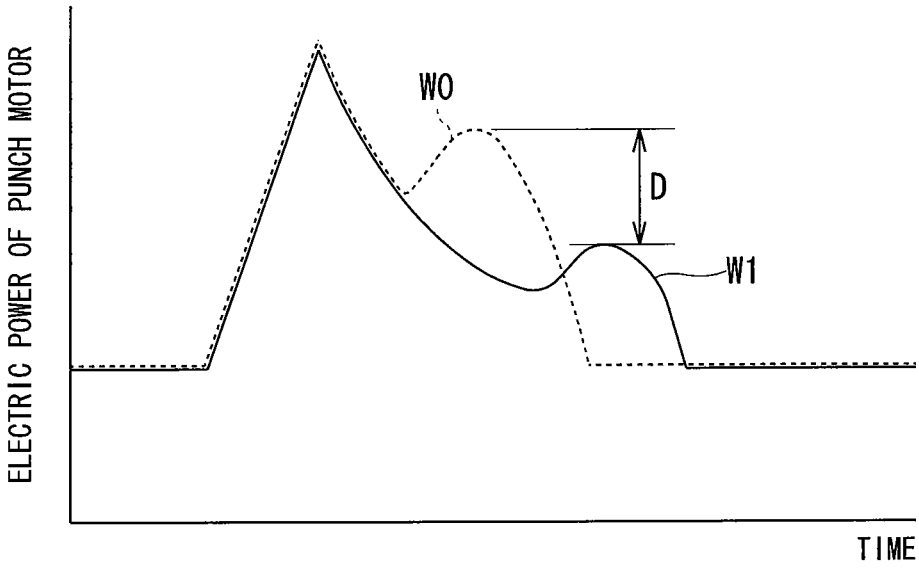
FIG. 11 is a graph of electric power waveforms of a punch motor in punching a sheet having thickness exceeding a threshold in the related art and the sheet processing apparatus according to the present embodiment.

FIG. 11 is a graph of electric power waveforms of the punch motor 303A in punching the sheet S having thickness exceeding a threshold in the related art and the sheet processing apparatus 2 according to the present embodiment.

According to at the beginning of the driving of the punch motor 303A of FIG. 11, there is little to distinguish a power level of an electric power waveform W1 in the sheet processing apparatus 2 according to the present embodiment from one of an electric power waveform W0 in the related art. In the present embodiment, it is necessary to slow the pickup speed of the sheet S fed from the image forming apparatus 1, or to lengthen the delay time, when the power waveform W1 is compared with the power waveform W0, because the power waveform W1 increases the punching time. However, the power waveform W1 is able to lower the power level at the punching by a power level difference D.

Figure 12:
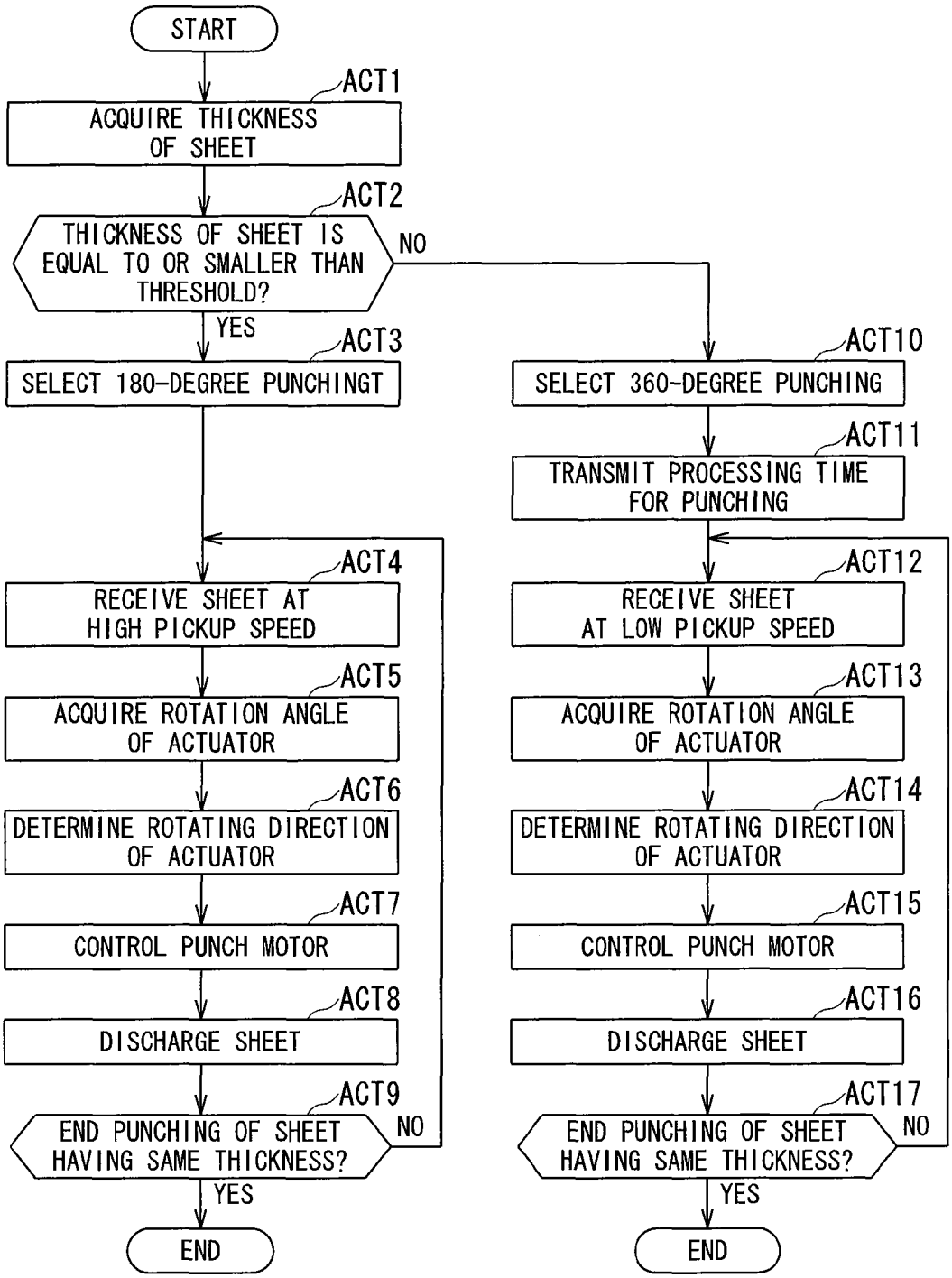
FIG. 12 is a flowchart for explaining the operation of the sheet processing apparatus according to the present embodiment.

The operation of the sheet processing apparatus 2 according to this embodiment is explained with reference to FIGS. 1 and 12. FIG. 12 is a flowchart for explaining the operation of the sheet processing apparatus 2 according to the present embodiment.

The sheet processing apparatus 2 acquires information concerning the thickness of the sheet S conveyed from the image forming apparatus 1 (ACT 1). The sheet processing apparatus 2 determines, on the basis of the thickness of the sheet S acquired in ACT 1, whether the thickness of the sheet S is equal to or smaller than the threshold (ACT 2). If the sheet processing apparatus 2 determines in ACT 2 that the thickness of the sheet S is equal to or smaller than the threshold (YES in ACT 2), the sheet processing apparatus 2 selects the 180-degree punching (ACT 3). The sheet processing apparatus 2 receives the sheet S, which is conveyed from the image processing apparatus 1, at relatively high pickup speed (ACT 4).

Subsequently, the sheet processing apparatus 2 acquires information concerning a rotation angle in the stop position of the actuator 303C detected by the rotation-angle censer 303E (shown in FIG. 3) (ACT 5). The sheet processing apparatus 2 determines, on the basis of the rotation angle of the actuator 303C acquired in ACT 5, a rotating direction of the actuator 303C in which the punching blades E do not idly rotate (ACT 6). As explained with reference to FIG. 10, the rotating directions of the actuator 303C determined in ACT 6 are opposite when the rotating angle in the stop position of the actuator 303C acquired in ACT 5 is 0 degree and when the rotating angle is 180 degrees.

Subsequently, the sheet processing apparatus 2 controls the driving of the punch motor 303A on the basis of the 180-degree punching selected in ACT 3 and the rotating direction determined in ACT 6 (ACT 7) and causes the punching unit 21 to perform punching of the sheet S.

The sheet processing apparatus 2 discharges the punched sheet S from the punching unit 21 to the staple unit 23 (ACT 8) and determines whether to end punching of the sheet S having the same thickness (ACT 9). If the sheet processing apparatus 2 determines in ACT 9 to end the punching of the sheet S having the same thickness (YES in ACT 9), the sheet processing apparatus 2 ends the operation.

On the other hand, if the sheet processing apparatus 2 determines in ACT 9 not to end the punching of the sheet S having the same thickness (NO in ACT 9), the sheet processing apparatus 2 receives the next sheet S, which is conveyed from the image forming apparatus 1, at relatively high pickup speed (ACT 4).

If the sheet processing apparatus 2 determines in ACT 2 that the thickness of the sheet S exceeds the threshold (NO in ACT 2), the sheet processing apparatus 2 selects the 360-degree punching (ACT 10). The sheet processing apparatus 2 transmits a punching time to the image processing apparatus 1 (ACT 11) and receives the sheet S, which is conveyed from the image processing apparatus 1, at relatively low pickup speed (ACT 12).

Subsequently, the sheet processing apparatus 2 acquires information concerning a rotation angle in the stop position of the actuator 303C detected by the rotation-angle censer 303E (shown in FIG. 3) (ACT 13). The sheet processing apparatus 2 determines, on the basis of the rotation angle of the actuator 303C acquired in ACT 13, a rotating direction of the actuator 303C in which the punching blades E idly rotate (ACT 14). As explained with reference to FIG. 10, the rotating directions of the actuator 303C determined in ACT 14 are opposite when the rotating angle in the stop position of the actuator 303C acquired in ACT 13 is 0 degree and when the rotating angle is 180 degrees.

Subsequently, the sheet processing apparatus 2 controls the driving of the punch motor 303A on the basis of the 360-degree punching selected in ACT 10 and the rotating direction determined in ACT 14 (ACT 15) and causes the punching unit 21 to perform punching of the sheet S.

The sheet processing apparatus 2 discharges the punched sheet S from the punching unit 21 to the staple unit 23 (ACT 16) and determines whether to end punching of the sheet S having the same thickness (ACT 17). If the sheet processing apparatus 2 determines in ACT 17 to end the punching of the sheet S having the same thickness (YES in ACT 17), the sheet processing apparatus 2 ends the operation.

On the other hand, if the sheet processing apparatus 2 determines in ACT 17 not to end the punching of the sheet S having the same thickness (NO in ACT 17), the sheet processing apparatus 2 receives the next sheet S, which is conveyed from the image forming apparatus 1, at relatively low pickup speed (ACT 12).

With the sheet processing apparatus 2 according to this embodiment, when the relatively thick sheet S is punched, it is possible to increase the speed of the punching heads 301 during the punching by performing the punching using cam curves of all the cams C wide in one rotation of the actuator 303C (the 360-degree punching). It is possible to start the punching with kinetic energy and supplement a fall in speed with the driving force of the punch motor 303A to perform the punching. As a result, with the sheet processing apparatus 2 according to this embodiment, a peak current of the punch motor 303A in punching the relatively thick sheet S can be held down. Therefore, it is unnecessary to provide a punch motor having a large driving force for punching the relatively thick sheet S. It is possible to reduce the size of a punch motor.

With the sheet processing apparatus 2 according to this embodiment, if the relatively thin sheet S is punched, it is possible to switch a form of punching to a form of punching in half rotation of the actuator 303C (the 180-degree punching). Therefore, it is possible to perform the punching in a short time.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A sheet processing apparatus comprising:

a punch motor;

an actuator configured to rotate by driving of the punch motor;

a punching blade configured to punch a sheet by driving of the actuator; and a controller configured to control the driving of the punch motor so that approach run is gained, if a thickness of the sheet exceeds a threshold, in a rotating direction of the actuator in which the punching blade does not move at the beginning of the driving of the punch motor.

2. The sheet processing apparatus according to claim 1, wherein the controller acquires data concerning a rotation angle of the actuator, determines a rotating direction of the actuator on the basis of the rotation amount and the rotation angle of the actuator, and controls the driving of the punch motor on the basis of the rotation amount and the rotating direction of the actuator.

3. The sheet processing apparatus according to claim 2, wherein the controller determines, if the thickness of the sheet exceeds the threshold, the rotating direction of the actuator in which the punching blade idly rotates, and determines, if the thickness of the sheet is equal to or smaller than the threshold, the rotating direction of the actuator in which the punching blade does not idly rotate.

4. The sheet processing apparatus according to claim 1, wherein the controller selects, if the thickness of the sheet exceeds the threshold, 360 degrees as a rotation amount of the actuator per one punching, and selects, if the thickness of the sheet is equal to or smaller than the threshold, 180 degrees as a rotation amount of the actuator per one punching.

5. The sheet processing apparatus according to claim 1, wherein the controller transmits, if the thickness of the sheet exceeds the threshold, a punching time to an image processing apparatus which feeds the sheet.

6. The sheet processing apparatus according to claim 1, wherein the controller acquires data concerning the thickness of the sheet from an image processing apparatus which feeds the sheet.

7. A sheet processing apparatus which has a punch motor, an actuator configured to rotate by driving of the punch motor, and a punching blade configured to punch a sheet by driving of the actuator, comprising:

control means for controlling the driving of the punch motor so that approach run is gained, if a thickness of the sheet exceeds a threshold, in a rotating direction of the actuator in which the punching blade does not move at the beginning of the driving of the punch motor.

8. The sheet processing apparatus according to claim 7, wherein the control means acquires data concerning a rotation angle of the actuator, determine a rotating direction of the actuator on the basis of the rotation amount and the rotation angle of the actuator, and control the driving of the punch motor on the basis of the rotation amount and the rotating direction of the actuator.

9. The sheet processing apparatus according to claim 8, wherein the control means determines, if the thickness of the sheet exceeds the threshold, the rotating direction of the actuator in which the punching blade idly rotates, and determine, if the thickness of the sheet is equal to or smaller than the threshold, the rotating direction of the actuator in which the punching blade does not idly rotate.

10. The sheet processing apparatus according to claim 7, wherein the control means selects, if the thickness of the sheet exceeds the threshold, 360 degrees as a rotation amount of the actuator per one punching, and select, if the thickness of the sheet is equal to or smaller than the threshold, 180 degrees as a rotation amount of the actuator per one punching.

11. The sheet processing apparatus according to claim 7, wherein the control means transmits, if the thickness of the sheet exceeds the threshold, a punching time to an image processing apparatus which feeds the sheet.

12. The sheet processing apparatus according to claim 7, wherein the control means acquires data concerning the thickness of the sheet from an image processing apparatus which feeds the sheet.

13. A sheet processing method comprising:

acquiring a rotation angle of an actuator which rotates by driving of a punch motor; and controlling the driving of the punch motor so that approach run is gained, if a thickness of the sheet exceeds a threshold, in a rotating direction of the actuator in which the punching blade does not move at the beginning of the driving of the punch motor.

14. The sheet processing method according to claim 13, wherein acquiring the rotation angle of the actuator further comprises: acquiring information concerning a rotation angle of the actuator, and determining a rotating direction of the actuator on the basis of the rotation amount and the rotation angle of the actuator; and controlling the driving of the punch motor further comprises: controlling the driving of the punch motor on the basis of the rotation amount and the rotating direction of the actuator.

15. The sheet processing method according to claim 14, wherein determining the rotating direction of the actuator further comprises: determining, if the thickness of the sheet exceeds the threshold, the rotating direction of the actuator in which the punching blade idly rotates, and determining, if the thickness of the sheet is equal to or smaller than the threshold, the rotating direction of the actuator in which the punching blade does not idly rotate.

16. The sheet processing method according to claim 13, further comprising:

selecting, if the thickness of the sheet exceeds the threshold, 360 degrees as a rotation amount of the actuator per one punching, and selecting, if the thickness of the sheet is equal to or smaller than the threshold, 180 degrees as a rotation amount of the actuator per one punching.

17. The sheet processing method according to claim 13, further comprising:

transmitting, if the thickness of the sheet exceeds the threshold, a punching time to an image processing apparatus which feeds the sheet.

18. The sheet processing method according to claim 13, further comprising:

acquiring data concerning the thickness of the sheet from an image processing apparatus which feeds the sheet.

* * * * *